US009221277B2

(12) United States Patent
Wang

(10) Patent No.: US 9,221,277 B2
(45) Date of Patent: Dec. 29, 2015

(54) PRINTING DEVICE AND METHOD FOR ELECTRONIC PAPER

(71) Applicant: BOE Technology Group Co., Ltd., Beijing (CN)

(72) Inventor: Dawei Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 30 days.

(21) Appl. No.: 14/056,408

(22) Filed: Oct. 17, 2013

(65) Prior Publication Data

US 2014/0111593 A1 Apr. 24, 2014

(30) Foreign Application Priority Data

Oct. 19, 2012 (CN) ..... 2012 1 0401940

(51) Int. Cl.
*B41J 3/407* (2006.01)

(52) U.S. Cl.
CPC ..... *B41J 3/4076* (2013.01)

(58) Field of Classification Search
USPC ..... 347/141
See application file for complete search history.

(56) References Cited

U.S. PATENT DOCUMENTS

| | | | | |
|---|---|---|---|---|
| 7,114,864 | B2 * | 10/2006 | Shimoda et al. | 400/76 |
| 2006/0017659 | A1 * | 1/2006 | Ogawa | B41J 3/4076 345/30 |
| 2014/0022625 | A1 * | 1/2014 | Fallon et al. | 359/296 |

* cited by examiner

*Primary Examiner* — Manish S Shah
*Assistant Examiner* — Renee I Wilson
(74) *Attorney, Agent, or Firm* — Frommer Lawrence & Haug LLP

(57) ABSTRACT

The invention relates to the field of printing devices, more particularly to an E-paper printing device and an E-paper printing method. The E-paper printing device provided by the invention comprises a printhead for applying an electric field to the E-paper, the printhead comprises a first printhead and a second printhead disposed opposed to the first printhead, the E-paper is fed through between the first printhead and the second printhead, and portions of the first printhead and the second printhead contacting with the E-paper respectively are flat surface. The E-paper printing device may perform rapid printing on the E-paper with high precision.

17 Claims, 4 Drawing Sheets

PRINTING DEVICE AND METHOD FOR ELECTRONIC PAPER

FIELD OF THE INVENTION

The present invention relates to the field of printing devices, and particularly to an electronic paper (E-paper) printing device and an E-paper printing method.

BACKGROUND OF THE INVENTION

Physical papers have been used as the primary media for information exchange for a long time and are consumed by not only inkjet printing but also laser printing. Meanwhile, graphics and texts may not be changed once printed on physical papers, making it impossible to reuse papers. As a result, the use of conventional physical papers severely wastes resources and is inconvenient in paper storing, paper carrying and paper management. With the development of display technology, E-paper has been recently proposed. The E-paper is advantageous over conventional physical papers in that it has light weight and softness so as to be carried and managed easily, it is erasable and rewritable to save resources, it displays clearly to enable a pleasing reading and so on.

Currently, E-paper is not actually used as reusable electronic paper on the contrary, it is mostly applied as display devices and made as self-driven E-book readers with display system for displaying texts and graphics. To implement a reusing E-paper, firstly, it is required a bistable E-paper, such as E-papers with electrophoretic display, cholesteryl phase display or ferroelectric LCD. And secondly, a printing device that may perform erasing and rewriting operation on E-paper over and again is needed. Thereby it can display different text and graphic information.

A laser printer among conventional physical paper printing devices will be described as an example. The printing device comprises an electrically pre-charged photosensitive selenium drum and powdered ink particles with opposite polarity as that of the drum. When printing on the physical paper by the printing device, a data signal received from a computer is transformed and then transferred to the surface of the drum, causing charges on the drum surface to change; as a result, charges on some regions of the drum surface are retained while those on other regions disappear. The regions of the drum surface which retain the charges adsorb the powdered ink particles. When the physical paper to be printed is fed into the printing device, it carries charges with the same polarity as that of the charges on the drum surface after being pressed by electrodes, though with a much larger amount, and attracts the powered ink particles on the drum surface thereto when passing through the drum, thereby forming graphics and texts on the surface of the physical paper.

A principle of displaying graphics and texts by E-papers such as the E-paper based on electrophoretic display technology is to arrange different patterns for some charged black particles and some oppositively-charged white particles. With reference to the above method for printing physical paper, when graphics and texts displayed on the E-paper are rewritten or graphics and texts are plotted on another E-paper, a voltage is applied across the E-paper to form an electric field such that the charged particles in the E-paper are moved, thereby erasing original graphics and texts on the E-paper or writing new ones onto the E-paper. Such a method is considered as a convenient and simple method. However, there is no E-paper printing device particularly designed for E-papers available now.

SUMMARY OF THE INVENTION

In view of the above disadvantage of conventional arts, an objective of the present invention is to provide an E-paper printing device which may perform rapid printing on E-papers with high precision.

An aspect of the invention provides an E-paper printing device comprising a printhead for applying an electric field to the E-paper, the E-paper printing device characterized in that the printhead comprises a first printhead and a second printhead disposed opposed to the first printhead, the E-paper is fed through between the first printhead and the second printhead, and portions of the first printhead and the second printhead contacting with the E-paper respectively are flat surfaces.

Preferably, both the first printhead and the second printhead are flat plate-like, and a distance between the first printhead and the second printhead is adjustable.

Preferably, the device further comprises an adjusting unit for driving the first printhead and/or the second printhead to move direct toward or away from each other, such that the distance between the first printhead and the second printhead is adjustable.

Preferably, the first printhead comprises a first substrate and pixel electrodes disposed on the first substrate, while the second printhead comprises a second substrate and a common electrode disposed on the second substrate, alternatively, the first printhead comprises a first substrate and pixel electrodes disposed on the first substrate, while the second printhead comprises a second substrate and a common electrode connection unit connected to a common electrode disposed on the E-paper, the first substrate and the second substrate are disposed opposed to each other, and the pixel electrodes and the common electrode are configured for generating electric fields which are directed from the pixel electrodes toward the common electrode or directed from the common electrode to the pixel electrodes.

Preferably, the first printhead comprises a plurality of pixel electrodes arranged on the first substrate as an array having two or more rows.

Preferably, the flat plate areas of the first printhead and the second printhead are the same.

Preferably, the device further comprises a plurality of switch elements, each of which is connected to one of the pixel electrodes and configured for switching the one pixel electrode between modes of generating and eliminating electric field.

Preferably, the switch elements are Thin Film Transistors.

Preferably, the device further comprises a paper feeding unit for driving the feeding of the E-paper, the paper feeding unit comprises a paper feeder roller for guiding a feeding direction of the E-paper and a step motor for rotating the paper feeder roller.

Another aspect of the invention provides a printing method employing any of the above E-paper printing devices, wherein a region between the opposed first and second printheads is defined as a printing region, which is divided equally along the paper feeding direction into an erasing region and a writing region, the E-paper is equally divided into N portions along the paper feeding direction, a length of each portion of the E-paper along the paper feeding direction is equal to a length of the erasing region along the paper feeding direction, the printing method comprises the following steps:

a same-time erasing and writing step of placing the nth portion ($1 \le n \le N-1$) of the E-paper in the writing region to have new graphics and texts to be written to the nth portion of the E-paper, and meanwhile, placing the (n+1)th portion in the erasing region to have existing graphics and text in the (n+1)th portion of the E-paper to be erased;

a step-feeding step of feeding the E-paper a step along the paper feeding direction with a step size equal to the length of each portion of the E-paper in the paper feeding direction, such that n=n+1; and a repeating step of repeating the same-time erasing and writing step and the step-feeding step in the case of determining n≠N, wherein an erasing step is performed on the first portion of the E-paper before the same-time erasing and writing step such that the first portion of the E-paper is placed in the erasing region in order to have the existing graphics and texts in the first portion of the E-paper to be erased; and wherein, in the case of determining n=N in the repeating step, place the Nth portion of the E-paper in the writing region in order to have new graphics and texts to be written to the Nth portion of the E-paper.

Still another aspect of the invention provides a printing method employing any of the above E-paper printing devices, wherein a region between the opposed first and second printheads is defined as a printing region, the printing method comprises the following steps:

placing the whole E-paper in the printing region;

erasing existing graphics and texts in the whole E-paper; and writing new graphics and texts into the whole E-paper.

With the present invention, the printing precision and accuracy of the E-paper is improved greatly, and thanks to the planar contacting the printing speed is significantly increased by simultaneously printing graphics and texts of multiline of pixels.

Figure 1A:
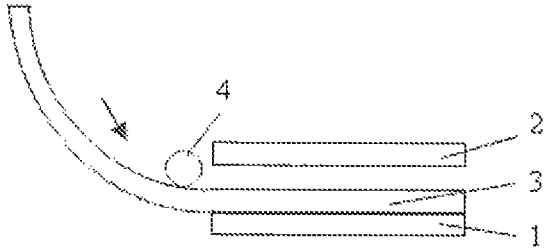
FIG. 1A is a schematic diagram showing a paper feeding procedure in accordance with Embodiment 1, in which an erasing region and a writing region are not identified.

In the drawings: 1. first printhead; 2. second printhead; 3. E-paper; 4. paper feeder roller; 5. first substrate; 6. pixel electrode; 7. switch element; 8. second substrate; 9. common electrode; 10. connection point/strip; 11. data line; 12. scan line; 13. microcapsule; 14. white particle; 15. black particle; 16. erasing region; 17. writing region.

DETAILED DESCRIPTION OF EMBODIMENTS

In order to make technical solutions of the invention more apparent to those skilled in the art, the E-paper printing device and method will be described in detail in connection with the drawings and the embodiments of the invention in the following.

Those skilled in the art will understand that the terms "first," "second," etc. are used to describe various components, regions and/or portions, which will not be defined by the terms. The terms are used for distinguishing a component, a region and/or a portion from another component, region and/or portion. Therefore, a first component, region and/or portion described in the following may also be referred to as a second component, region and/or portion.

An E-paper printing device comprises a printhead for applying an electric field to an E-paper, the printhead comprises a first printhead and a second printhead disposed opposed to each other, the E-paper is fed through between the first printhead and the second printhead, portions of the first printhead and the second printhead contacting with the E-paper respectively are flat surfaces.

Embodiment 1

Figure 10:
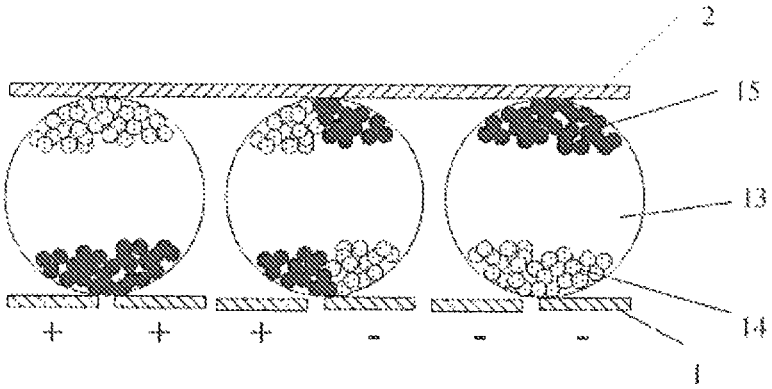
FIG. 10 is a schematic configuration of an E-paper based on electrophoretic display technology.

E-paper is a novel electronic display device. Specifically, an E-paper based on electrophoretic display technology as illustrated in FIG. 10 comprises a rewritable display layer and a base layer superimposed with each other, both of which are sheet structures having certain flexibility. Here, the base layer is made of a transparent material and has a plurality of microcapsules 13 (having a diameter in the order of a micrometer) disposed therein. A microcapsule comprises a plurality of charged black particles 15 and a plurality of charged white particles 14. The charges carried by the black particles 15 and those carried by the white particles 14 are of opposite polarities, and the black and white particles move upwards and downwards within the base layer according to the electric field applied thereon. Thus, the charged particles will move when an appropriate electric field is applied to the microcapsule, thereby generating different combinations of white and black on the display layer and eventually displaying graphics and texts. Here the graphics and texts include text characters, numerical, graphical images and the like.

FIG. 10 illustrates a configuration of microcapsules in the base layer of the E-paper based on electrophoretic display technology as well as an arrangement of the charged particles in the microcapsules under a certain electric field. In the embodiment, the white particles carry positive charges while the black particles carry negative charges. When an external electric field (E-field) is applied to the microcapsules, it is seen from FIG. 10 that the negatively-charged black particles move in the direction opposite to the external E-field within the microcapsules, while the positively-charged white particles move in the same direction as the external E-field within the microcapsules, under the effect of the external E-field, eventually forming the arrangement as shown in FIG. 10. When observed from the upper surface of the display layer (the upper side of FIG. 10), the white particles-aggregated regions are displayed as white, and the black particles-aggregated regions are displayed as black, thereby displaying different graphics and texts on the display layer.

In the embodiment, an E-paper printing device for printing graphics and texts on the above E-paper is provided. The E-paper printing device comprises a printhead for applying an electric field to the E-paper. The printhead comprises a first printhead 1 and a second printhead 2 disposed opposed to each other as illustrated in FIG. 10. The E-paper is fed through between the first printhead and the second printhead, and portions of the first printhead and the second printhead contacting with the E-paper respectively are flat surfaces. Both the first printhead 1 and second printhead 2 are flat plate-like, and a distance between the first printhead and the second printhead is adjustable.

Figure 5:
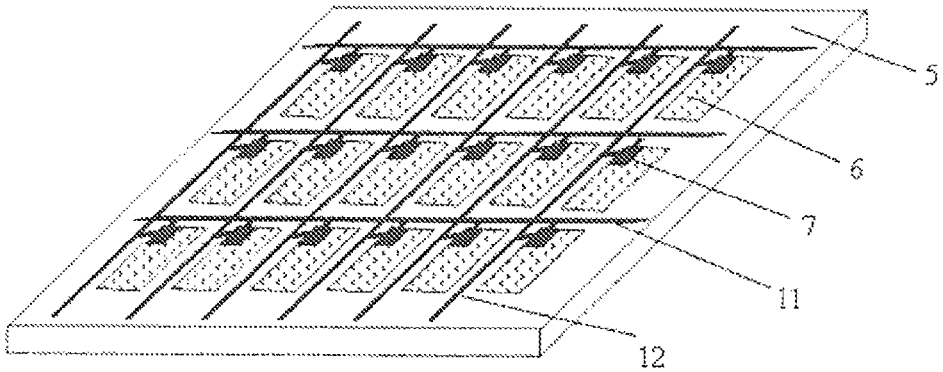
FIG. 5 is a schematic configuration of a first printhead of Embodiments 1 to 5.
Figure 6:
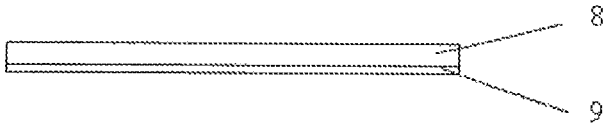
FIG. 6 is a schematic configuration of a second printhead of Embodiments 1 to 4.

For the purpose of correctly displaying graphics and texts, the E-paper printing device has not only to erase original graphics and text information on the E-paper but also to write graphics and text information to be displayed on the E-paper according to the graphics and text information to be displayed. According to a technical solution of the invention, the E-paper is erased and written using an E-field. As illustrated in FIGS. 5 and 6, the first printhead 1 comprises a first substrate 5 and pixel electrodes 6 disposed on the first substrate 5, the second printhead 2 comprises a second substrate 8 and a common electrode 9 disposed on the second substrate 9, and the pixel electrodes 6 and the common electrode 9 are configured for generating E-fields which are directed from the pixel electrodes toward the common electrode or an E-field directed from the common electrode to the pixel electrodes.

As illustrated in FIG. 1A, the first printhead 1 of the E-paper printing device is disposed at the lower side and the second printhead 2 is disposed at the upper side. The E-paper 3 is fed in the direction as indicated by the arrow. As illustrated in FIG. 5, according to the embodiment, the first printhead 1 comprises a plurality of pixel electrodes 6 arranged on the substrate 5 as an array having two or more rows. The device further comprises a plurality of switch elements 7; each of the switch elements 7 is connected to a corresponding pixel electrode 6 and configured for switching the corresponding pixel electrode 6 between modes of generating and eliminating the electric field. That is, the first printhead 1 comprises at least two rows of pixel electrodes 6 and switch elements 7 respectively corresponding to each of the pixel electrodes 6, where the pixel electrodes 6 are for applying an E-field to the E-paper 3, and the switch elements 7 are electrically connected to the pixel electrodes 6 in order to control the pixel electrodes 6 applying/not applying the E-field by switching between ON and OFF. Here the switch elements 7 are Thin Film Transistors (TFTs).

Specifically, as illustrated in FIG. 5, intersections between data lines 11 (indicated by horizontal lines in FIG. 5) and scan lines 12 (indicated by vertical lines in FIG. 5) define a plurality of pixel regions, which are arranged in the form of an array having a plurality of rows and columns. A pixel electrode 6 and a switch element 7 (i.e. a TFT element) for switching the pixel electrode 6 between ON and OFF states are correspondingly disposed in each pixel region. The first substrate 5 further comprises a data driver and a scan driver (not shown in FIG. 5), where the data driver is respectively connected to each column of TFT elements through the data lines 11, the scan driver is respectively connected to each row of TFT elements through the scan lines 12. Specifically, a TFT element comprises a gate electrode, a source electrode and a drain electrode. Source electrodes of each column of TFT elements are extended in the vertical direction to connect to the data line (i.e. the source line) 11 and then to the data driver. Gate electrodes of each row of TFT elements are extended in the horizontal direction to connect to the scan line (i.e. the gate line) 12 and then to the scan driver. Drain electrodes of the TFT elements are connected to respective pixel electrodes 6.

As illustrated in FIG. 6, the second printhead comprise a second substrate 8 and a common electrode 9 disposed on the second substrate 8. Preferably, the common electrode 9 is an ITO electrode. During the printing process, an E-field which is directed from one pixel electrode 6 toward the common electrode 9 or directed from the common electrode 9 toward the pixel electrode 6 is formed between the pixel electrode 6 and the common electrode 9. The TFT element controls the switching between generating/eliminating of the E-field between the pixel electrode and the common electrode.

Similar to printing devices for physical papers, the E-paper printing device may further comprises an interface unit, which connects the E-paper printing device to a computer and transforms formatted data transmitted from the computer into data with a format processable by the E-paper printing device. The data with such transformed format is transformed into corresponding control signals or data signals by the scan driver or the data driver and then loaded into the TFT elements. Here, the scan driver applies a voltage to the scan lines 12. When the scan voltage is applied to a scan line 12, each and every row of TFT elements connected with the column of scan line 12 are turned on. At this time, when the data driver applies a voltage through a data line 11 to the source electrode of a TFT element on a corresponding row and a TURN-ON condition of the corresponding TFT element is met, the TFT element is turned on, and the pixel electrode 6 connected to the drain electrode of the turned-on TFT element receives the voltage. The received voltage on the pixel electrode 6 and the voltage on the common electrode 9 form an E-field, which acts on the E-paper and causes charged particles in certain microcapsules 13 of the E-paper to move and get arranged according to the property of the E-field. Therefore, a certain position of the E-paper has its original graphics and texts information erased or new graphics and texts information rewritten thereon.

In the embodiment, a size of the printhead of the E-paper printing device is smaller than or equal to a size of the E-paper to be printed. The flat plate areas of the first printhead and the second printhead are the same. Several printings are needed to complete the whole E-paper's printing, and the number of printings is specifically determined by a ratio of the size of the E-paper to the size of the printhead. In the embodiment, erasing original graphics and texts and writing new graphics and texts on the E-paper are realized by the various E-fields generated from combination of voltages of the pixel electrodes 6 and the common electrode 9.

Furthermore, the device comprises a paper feeding unit for driving the feeding of the E-paper. The paper feeding unit comprises a paper feeder roller 4 for guiding the feeding direction of the E-paper and a step motor (not illustrated in FIGS. 1 to 4) for rotating the paper feeder roller. The paper feeding unit of the E-paper printing device is the same as paper feeding units of conventional physical paper printing devices. The printheads are disposed at a frontend of the feeding direction of the paper feeding unit (indicated by the arrow of FIGS. 1 and 3), that is, the printheads are disposed at the frontend of the paper feeder roller 4.

The device further comprises a driving unit (not illustrated in FIGS. 1 to 4). The driving unit is generally made up of an IC comprising a logic circuit and a memory circuit. The driving unit controls timing of high and low levels of the scan signal according to graphic data of the information to be displayed or ambient brightness, thereby adjusting ON and OFF timing of the driving signal for the TFT elements in order to print the E-paper.

The device further comprises an adjusting unit (not illustrated in FIGS. 1 to 4). The adjusting unit is used for driving the first and/or the second printhead to move direct toward or away from each other, such that the distance between the first and the second printheads is adjustable. The first and second printheads can be controlled by the adjusting unit to contact or separate with the E-paper.

A process of printing on an E-paper using the E-paper printing device according to the embodiment will be described in the following. The printing process comprises a paper feeding step, a pre-printing step, a printing step and a post-printing step. The printing step comprises an erasing operation and a writing operation, wherein the driving unit connected to both of the first printhead 1 and the second printhead 2 inputs data to the pixel electrodes 6 and the common electrode 9. The printing method in accordance to the embodiment is a same-time partitioned printing method, that is, the erasing operation and the writing operation are performed respectively on different regions at the same time, as illustrated by a flow chart of FIG. 8.

Figure 1B:
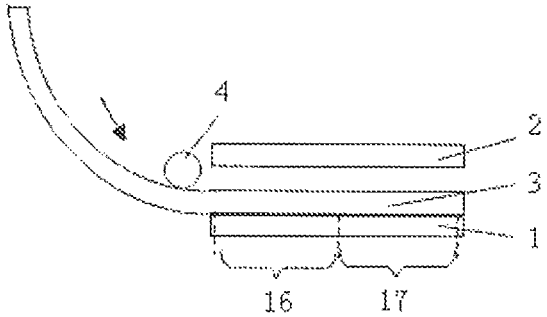
FIG. 1B is a schematic diagram showing a paper feeding procedure in accordance with Embodiment 1, in which an erasing region and a writing region are identified.

In the printing method, the E-paper is equally divided into N portions along the paper feeding direction. A region between the opposed first and second printheads is defined as a printing region, which is divided equally along the paper feeding direction into an erasing region and a writing region. That is, the printing region is equally divided into two regions by rows of the pixel electrodes in the paper feeding direction. A length of each of the two regions along the paper feeding direction is equal to a length of each portion of the E-paper along the paper feeding direction. The region out of the two regions which is close to the paper feeder roller 4 is the erasing region 16, and the other region which is further from the paper feeder roller 4 is the writing region 17, as illustrated in FIG. 1B. For convenience of description, the portion of E-paper first entering the printing region along the paper feeding direction under the driving of the paper feeding unit is defined as a first portion, and those portions of the E-paper consequently entering the printing region are respectively defined as a second portion, a third portion, and so on; and the portion lastly entering the printing region is defined as a Nth portion.

The same-time partitioned printing method comprises the following steps:

A same-time erasing and writing step in which the nth portion ($1 \leq n \leq N-1$) of the E-paper is placed in the writing region to have new graphics and texts to be written to the nth portion of the E-paper, and meanwhile, the (n+1)th portion is placed in the erasing region to have existing graphics and text in the (n+1)th portion of the E-paper to be erased;

A step-feeding step in which the E-paper is fed a step along the paper feeding direction with a step size equal to the length of each portion of the E-paper in the paper feeding direction, such that $n=n+1$; and A repeating step in which, in the case of determining $n \neq N$, the same-time erasing and writing step and the step-feeding step are repeated.

Here, an erasing step is performed on the first portion of the E-paper before the same-time erasing and writing step such that the first portion of the E-paper is placed in the erasing region in order to have the existing graphics and texts in the first portion of the E-paper to be erased.

Also here, in the case of determining $n=N$ in the repeating step, the Nth portion of the E-paper is placed in the writing region in order to have new graphics and texts to be written to the Nth portion of the E-paper.

Figure 8:
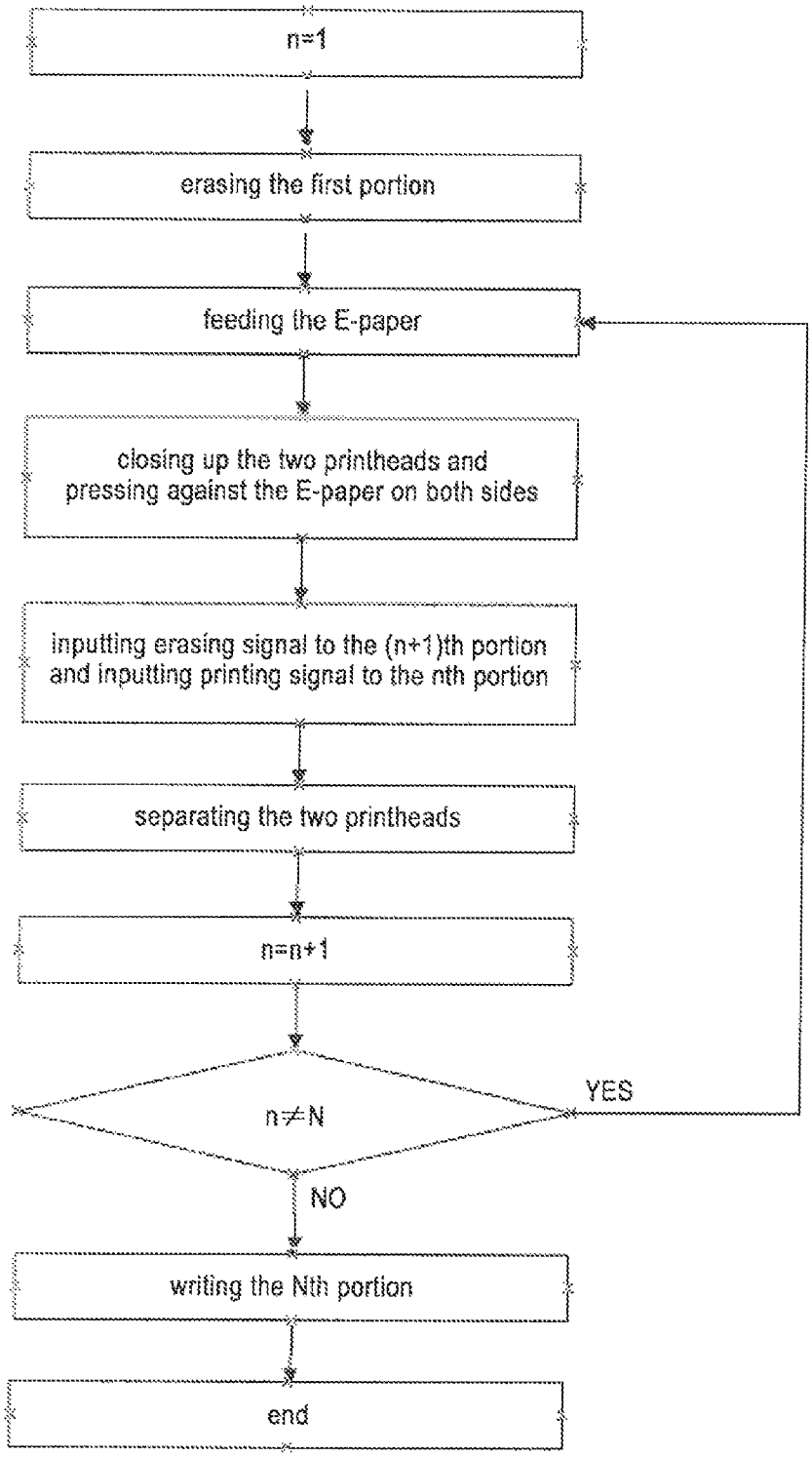
FIG. 8 is a flowchart of performing a same-time partitioned printing on an E-paper in accordance to Embodiment 1.

As illustrated in the flow chart of FIG. 8, the process of printing on the E-paper using the E-paper printing device is specifically as follows:

In the paper feeding step the E-paper is fed into the E-paper printing device. That is, the E-paper is sequentially fed under the driving of the paper feeding unit. In this case, the first printhead 1 and the second printhead 2 are spaced by a distance. When the nth ($1 \leq n \leq N-1$) portion of the E-paper 3 is fed to the right place, i.e., the nth portion in the writing region 17 and the (n+1)th portion in the erasing region 16, the E-paper is in contact with the first printhead 1 while spaced away from the second printhead 2 by a distance, as illustrated in FIG. 1A or 1B. Here a speed of feeding the E-paper 3 is determined to ensure smooth feeding of the E-paper 3 while stability of mechanical movement is also considered.

During the paper feeding step, a length of one feeding for the E-paper is equal to half of the printable length of pixels along the paper feeding direction of the printheads, that is, the length of each portion of the E-paper in the paper feeding direction. The speed of the paper feeder roller 4 driven by the step motor in the paper feeding unit of the E-paper printing device depends on the number of the printable rows (or the length) of pixels per printing in the writing region.

Figure 2:
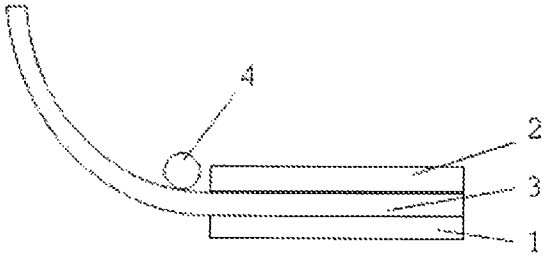
FIG. 2 is a schematic diagram of a printing procedure of Embodiment 1.

In the pre-printing step, the two printheads move direct toward each other and press against both sides of the E-paper. That is, the second printhead 2 which is spaced away from the E-paper to be printed by a distance moves close to the E-paper until the second printhead 2 contacts the E-paper 3 and applies a pressure on the E-paper. At this time, both the first and the second printheads are pressing against the E-paper on each side as illustrated in FIG. 2. In the embodiment, because of the electrophoretic-based E-paper, the pressures applied on the E-paper from the first and second printheads should be appropriate to ensure not only that the E-paper is clamped between the printheads but also that a resistance of the E-paper in the printing region is adjusted to a suitable range so as to apply a sufficient voltage across the microcapsules, which adjusts the arrangement of the white and black particles in cooperation with the external E-field. The voltages needed to be applied on various types of electrophoretic display E-paper during the printing process may be different. Thus the contact pressure applied to the E-paper by the first and second printheads should be adjusted during the printing process according to the size and specification of the E-papers.

In the printing step, an erasing signal is input to erase the original graphics and texts in the E-paper and a printing signal is input to write new graphics and texts in the E-paper. In the embodiment the step comprises: performing erasing operation on the (n+1)th portion of the E-paper in the erasing region, meanwhile, performing writing operation on the nth portion in the writing region. That is, during each printing operation the interface unit simultaneously inputs the erasing signal to the erasing region and the printing signal of data to be printed to the writing region. In this case, the (n+1)th portion of the E-paper corresponding to the erasing region has the existing graphics and texts erased and at the same time the nth portion of the E-paper corresponding to the writing region has new graphics and texts written thereto, thereby finishing a portion of printing graphics and texts on the E-paper.

Specifically, a detailed process of the erasing and writing operations on the E-paper based on electrophoretic display technology is as follows.

During the erasing process, a negative voltage with a specified level (or a voltage with zero level) is applied to (the upper side of) the common electrode 9. At this point, the scan driver applies a specified voltage to the corresponding scan line on (the lower side of) the pixel electrodes 1, that is, to the gate electrodes of the corresponding TFT elements. Meanwhile, the data driver applies specified voltages to the corresponding data lines, that is, to source electrodes of the corresponding TFT elements, such that the drain electrodes of the corresponding TFT elements are turned on and positive voltages with a specified level are applied to the corresponding pixel electrodes 6. In this case, E-fields are formed between the first printhead 1 and the second printhead 2, that is, E-fields which are directed from the common electrode 9 to the pixel electrodes 6 are formed. According to the afore-mentioned principle of displaying black and white graphics and texts by the E-paper, a lot of positively-charged white particles are aggregated at the side close to the common electrode 9 (that is the upper surface) of the E-paper 3, completely turning the color of the display surface of the E-paper into white (alternatively, polarities of the voltages applied to the common electrode 9 and the pixel electrodes 6 may be exchanged such that the display surface of the E-paper 3 is completely turned into black). That is to say, the existing graphics and texts information previously written on the E-paper is erased and the E-paper is reset.

During the writing process, the principle of writing graphics and texts on the E-paper is the same as that of erasing except that the voltages on the pixel electrodes 6 are not constant. Instead, a certain negative or positive voltage is respectively applied to each pixel electrode in specific region according to graphic data of the graphics and text information to be display, thereby various E-fields which are directed from the pixel electrodes 6 to the common electrode 9 or vice versa are formed at different regions between the pixel electrodes and the common electrode, forming white or black graphics and texts at the corresponding locations on the E-paper.

In the post-printing step, the two printheads are separated. That is, the second printhead 2 is moved away from the E-paper 3.

In the step-feeding step, the E-paper is sequentially fed along the paper feeding direction with a step size equal to the length of each portion of the E-paper in the paper feeding direction, under the driving of the paper feeding unit, causing the E-paper to move forward by one step along the paper feeding direction. Thus, the nth portion previously written in the writing region is moved out of the printing region, and the (n+1)th portion of the E-paper previously erased in the erasing region is placed in the writing region, thereby increasing n by one, i.e., n=n+1.

In the repeating step, it determines whether the increased n is equal to N. In the case of n≠N, the processes from the paper feeding step to the step-feeding step are repeatedly executed, such that the portion of the E-paper in the erasing region may be erased and the portion of E-paper in the writing region is written in.

Here, before the paper feeding step, when the E-paper is firstly fed into the device, only the first portion of the E-paper is placed in the erasing region 16 and none of the rest portions of the E-paper are in the printing region. Thus, the erasing operation is only performed on the first portion when the E-paper is firstly fed. That is, the first portion of the E-paper has the graphics and texts erased, while the rest portions of the E-paper do not have the existing graphics and texts erased.

Furthermore, in the case it is determined that n is equal to N in the above repeating step, that is, the Nth portion of the E-paper has been placed in the writing region 17 when the E-paper is lastly fed and the other portions of the E-paper has passed through the whole printing region and moved out of the printhead, the printing of the Nth portion only includes writing new graphics and texts into the Nth portion of the E-paper, while no erasing of existing graphics and texts or writing of new graphics and texts to the other portions of the E-paper is performed. Up till now, the printing of graphics and texts on the whole E-paper is finished, that is, printing of the E-paper is completed.

In the embodiment, a more efficient printing method divides the E-paper into two parts (N=2). An erasing operation is first performed on the first portion of the E-paper. Then a writing operation is performed on the first portion of the E-paper while an erasing operation is performed on the second portion of the E-paper. Next, a writing operation is performed on the second portion of the E-paper, thus finishing the whole printing of graphics and texts on the E-paper.

In the process of printing of the E-paper in accordance to the embodiment of the invention, since the E-paper is printed by portions one by one, there is no specific requirement on the size of the E-paper and the flat plate size of the printheads. Even if the first printhead covers only two rows of pixel electrodes, it is still suitable for printing large E-papers. In this case, it would suffice if the widths of the printheads of the printing device along a direction vertical to the paper feeding direction are equal to or larger than the width of the E-paper. Here the printing program may be compiled with reference to printing programs for printing physical papers line by line in the prior art. Furthermore, the printing method is not limited to printing planar E-papers; rather, it can also print curved E-papers.

It can be appreciated that positions of the first and second printheads in accordance to the embodiment may be exchanged. That is, it may employ a configuration having a first printhead comprising a first substrate and a common electrode disposed on the first substrate and a second printhead comprising a second substrate and pixel electrodes disposed on the second substrate. In this case, when performing the actual printing, it only needs to exchange voltage polarities or switch control ports when the interface unit applies voltages to individual pixel electrodes and common electrode, which will not be elaborated here.

Embodiment 2

The embodiment differs from Embodiment 1 in that the size of the E-paper is smaller than or equal to an area of the printing region of the E-paper printing device. The embodiment makes use of a different-time same-region printing method, that is, the E-paper is erased in a whole and then written in a whole at a different time.

In the different-time same-region printing method, the printing region of the E-paper printing device is no longer divided into an erasing region and a writing region. An erasing operation is performed on the E-paper in the printing region during a first time period and then a writing operation is performed in a second time period. The printing method comprises the steps of:

placing the whole E-paper in the printing region;

erasing existing graphics and texts in the whole E-paper; and writing new graphics and texts into the whole E-paper.

Figure 9:
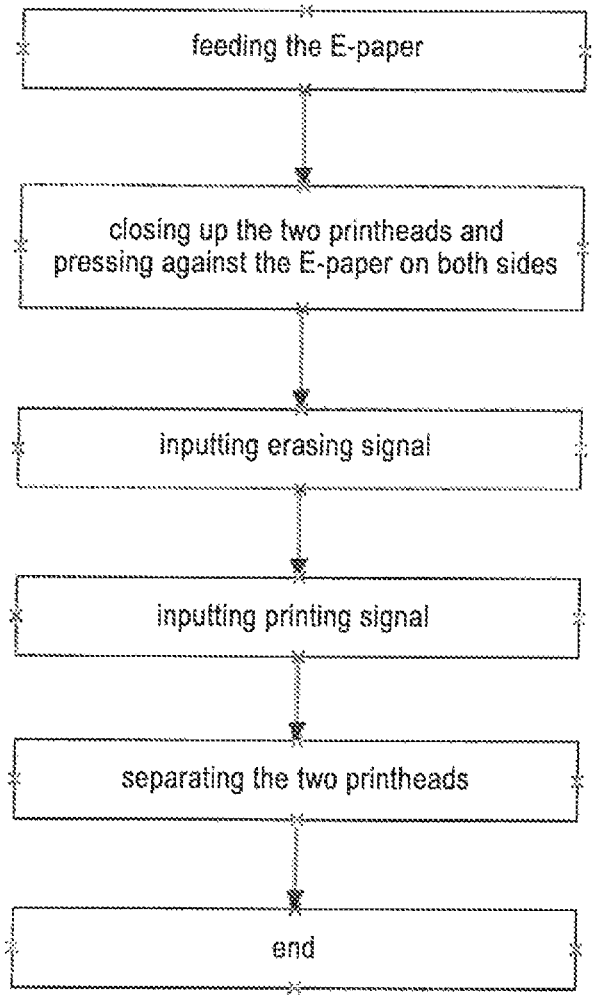
FIG. 9 is a flowchart of performing a different-time same-region printing on an E-paper in accordance to Embodiment 2.

As illustrated in the flow chart of FIG. 9, the printing method specifically comprises the following steps.

Figure 3:
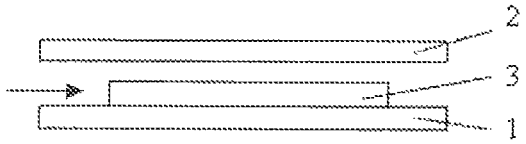
FIG. 3 is a schematic diagram of a paper feeding procedure of Embodiment 2.

In a paper feeding step, the E-paper is sequentially fed under the driving of the paper feeding unit or manually, such that the whole E-paper is placed in the printing region. At this point, the first printhead 1 and the second printhead 2 are spaced by a distance as illustrated in FIG. 3. There is no requirement at all on the feeding speed of the E-paper in the paper feeding step of this printing method.

Figure 4:
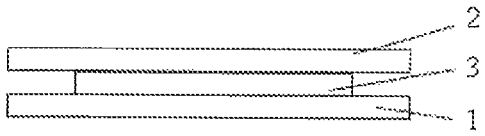
FIG. 4 is a schematic diagram of a printing procedure of Embodiment 2.

In a pre-printing step, the second printhead 2 which is spaced away from the E-paper to be printed by a distance moves close to the E-paper until the second printhead 2 contacts the E-paper 3 and applies a pressure to the E-paper, such that both the first and the second printheads are pressing against the E-paper on both sides. The pressure also ensures a voltage applied on the E-paper to be in a range suitable for implementing printing and erasing, as illustrated in FIG. 4.

In a printing step, firstly the erasing operation on the whole E-paper is performed and then the writing operation to the whole E-paper is performed. During printing, the interface unit first inputs an erasing signal to the pixel electrodes and/or common electrode of the printing region, and then inputs a data-writing signal to the pixel electrodes and/or common electrode of the printing region at a different time, thereby achieving the plot of graphics and texts. The detailed erasing and writing processes of the embodiment are the same as that of Embodiment 1 and will not be elaborated here.

In a post-printing step, the second printhead is moved away from the E-paper and the E-paper is taken away.

The configuration of the E-paper printing device in accordance to the embodiment is completely the same as that of Embodiment 1 and will not be described here. As for the printing principle of the E-paper, it is essentially the same as that of Embodiment 1: both have the erasing and writing operations, and the process of the erasing and writing operations are the same, with the exception that each step is repeated only once during the whole printing process.

Similarly, the positions of the first and second printheads of the embodiment may be exchanged, that is, the first printhead is disposed at the lower side while the second print head at the upper side; the driving unit and interfacing unit connected thereto should be exchanged accordingly.

The printing method of the embodiment is particularly suitable for E-papers having a size smaller than the size of the printing region. The E-papers are fed to the printing region of the E-paper printing device in a whole, and erasing operation and writing operation are performed one after another, thereby easily printing the whole paper, which significantly improves the printing efficiency.

According to the embodiment, during the paper feeding step and the pre-printing step, the E-paper is placed in the printing region of the E-paper printing device through automatic paper feeding or manually, then the first and second printheads are made to press against the E-paper and a contact pressure within a range is satisfied; during the printing step, the E-paper is firstly erased in a first time period and then written on in a second time period; during the post-printing step, the first and second printheads are separated and the printed E-paper is taken away and a new printing process may be then performed by replacing another E-paper to be printed.

The E-paper printing device and method of the embodiment are generally used to print E-papers having a size smaller than or equal to that of the printing region.

Embodiment 3

Though the E-paper to be printed is still an E-paper based on electrophoretic display technology, the embodiment differs from Embodiments 1 and 2 in that only the black particles of the microcapsules in the base layer of the E-paper are charged and the white particles dispersed in the microcapsules are not charged.

The E-paper is displayed as white when no E-field acts on it. Under the influence of the E-field, the charged black particles move to the upper side of the microcapsules and the corresponding regions of the E-paper are displayed as black.

The printing process for the E-paper of the embodiment also comprises an erasing operation and a writing operation. Accordingly, an E-field is applied in the erasing operation to reset the E-paper, and the writing operation is the same as that of Embodiments 1 and 2.

The E-paper printing method of the embodiment may be any of those of Embodiment 1 or 2, with the same printing principle and processes, which will not be described here.

Naturally, in accordance with the embodiment, it is also possible that white particles in the microcapsules in the base layer of an E-paper are charged and black particles dispersed in the microcapsules are non-charged. Accordingly, it only needs to change the external E-field and shoot through current during the printing process.

Embodiment 4

The embodiment differs from Embodiments 1 to 3 in that the E-paper to be printed is a cholesteric or ferroelectric LC E-paper. In the cholesteric or ferroelectric LC E-paper, liquid crystals filled in the base layer deflect (or twist) under the action of external E-field to display graphics and texts on the display layer.

In comparison with Embodiments 1 to 3, an external E-field for twisting the LCs has to be provided between the first and second printheads to display graphics and texts on the cholesteric or ferroelectric LC E-paper. Thus, when printing the E-paper of the embodiment, during the pre-printing step when the first and second printheads close up and press against the E-paper, it only needs to ensure that the E-paper is clamped between the two printheads (on one hand the E-paper remains immobile, on the other hand the distance between the pixel electrodes on the first printhead and the common electrode on the second printhead is fixed), regardless whether or not the contact pressure imposed on the E-paper by the first and second printheads is within a certain range.

The E-paper printing method of the embodiment may be either of Embodiment 1 or 2, with the same printing principle and processes, which will not be described here.

Embodiment 5

In the embodiment, the E-paper to be printed is different from that of Embodiments 1 to 4. Accordingly, a configuration of the E-paper printing device is different from that of Embodiments 1 to 4.

Figure 7:
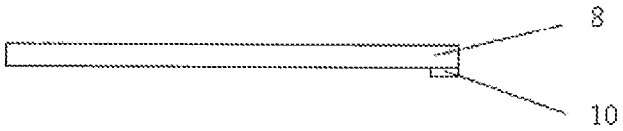
FIG. 7 is a schematic configuration of a second printhead of Embodiment 5.

In the embodiment, common electrode is added to the E-paper to be printed, based on Embodiments 1 to 4. As a result, the second printhead of the E-paper printing device of the embodiment would require only a second substrate and a connection device for electrically connecting with the common electrode in the E-paper to be printed, as shown in FIG. 7. The connection device may be a connection device 10 such as a connection point or a connection strip, a position of the connection device 10 corresponds to the position of the electrical connection point or strip on the common electrode of the E-paper. That is to say, a common electrode is omitted in the second printhead of the E-paper printing device of the embodiment and only the second substrate 8 is left as a contact surface for contacting with the E-paper and the first printhead 1. Meanwhile, the connection device 10 for electrical connection with the E-paper is disposed on the second substrate 8. The connection point or connection strip used as the connection device 10 may be realized in various ways, which are customary means for electrical connections and will not be described here.

Specifically, in the E-paper printing device of the embodiment, the first printhead 1 comprises a first substrate 5 and pixel electrodes 6 disposed on the first substrate 5, the second printhead 2 comprises a second substrate 8 and a common electrode connection device 10, which is used for connecting to the common electrode disposed on the E-paper 3; the first substrate 5 and the second substrate 8 are disposed opposed to each other; the pixel electrodes 6 and the common electrode disposed on the E-paper are used for generating E-fields which are directed from the pixel electrodes to the common electrode or vice versa.

The E-paper printing device of the embodiment is suitable for various types of E-papers having common electrodes preset therein, such as electrophoretic display E-papers having microcapsules with two kind of oppositively-charged particles as described in Embodiments 1 and 2, electrophoretic display E-papers with only one charge as described in Embodiment 3, and the cholesteric or ferroelectric LC E-paper as described in Embodiment 4. Since a second printhead without common electrode is used and only the second substrate is in contact with the E-paper, the contact between the second printhead and the E-paper is more straightforward. It is especially advantaged in the case of the electrophoretic display E-papers, in which the voltage is directly applied to the E-paper via the connection point or strip, thereby reducing the requirement of having appropriate contact pressure on the E-paper by the first and second printheads and more easily meeting the contact pressure requirement during printing by the E-paper printing device.

The E-paper printing method using the E-paper printing device of the embodiment may be any of the methods of Embodiments 1 to 4, with the same printing principle and processes, which will not be described here.

In the invention, a flat plate-like first printhead with pixel electrodes and a flat plate-like second printhead with a common electrode are employed. The pixel electrodes may utilize the same configuration as TFT array substrates in convention flat panel display devices, which means technologies for fabricating large areas of high precision TFT array substrate, based on the currently available display panel fabrication technology, may be used to the E-paper printing device of the invention. Such technologies will significantly improve the printing precision of the E-paper and easily realize high precision continuous printing control. The portion of the plate-like printhead for contacting with the E-paper is a flat surface, which may eliminates deformation of the E-paper, making alignment precision of the E-paper in the E-paper printing device high and significantly improving the printing precision. Meanwhile, having a flat contact portion makes it possible to print graphics and texts in plurality rows of pixels, which improves the printing speed. Moreover, the invention may employ either a same-time partitioned printing method or a different-time same-region printing method on the E-paper, which makes it easy for users to make choices based on specific scenarios.

The E-paper printing device of the invention is especially suitable for rapid, accurate and reparative printing of bistable E-papers.

It can be understood that what described above is illustrative embodiments for explaining the principle of the invention and not limitative to the scope of the disclosure. Various modifications and variations can be made by the person skilled in the art without departing from the spirit and scope of the present invention. It is intended that the present invention cover such modifications and variations.

The invention claimed is:

1. An E-paper printing device comprising:

a printhead for applying an electric field to the E-paper, wherein the printhead comprises a first printhead and a second printhead disposed opposed to the first printhead, the E-paper is fed through between the first printhead and the second printhead, and portions of the first printhead and the second printhead contacting with the E-paper respectively are flat surface, and a region between the opposed first and second printheads is defined as a printing region, which is divided equally along a feeding direction of the E-paper into an erasing region and a writing region; and an adjusting unit for driving the first printhead and the second printhead to move direct toward or away from each other, such that the distance between the first printhead and the second printhead is adjustable.

2. The E-paper printing device of claim 1, wherein the first printhead and the second printhead are flat plate-like, and a distance between the first printhead and the second printhead is adjustable.

3. The E-paper printing device of claim 2, wherein: the first printhead comprises a first substrate and pixel electrodes disposed on the first substrate, while the second printhead comprises a second substrate and a common electrode disposed on the second substrate, or the first printhead comprises a first substrate and pixel electrodes disposed on the first substrate, while the second printhead comprises a second substrate and a common electrode connection unit connected to a common electrode disposed on the E-paper; and the first substrate and the second substrate are disposed opposed to each other, and the pixel electrodes and the common electrode are configured for generating electric fields which are directed from the pixel electrodes to the common electrode or directed from the common electrode to the pixel electrodes.

4. The E-paper printing device of claim 3, wherein the first printhead comprises a plurality of pixel electrodes arranged on the first substrate as an array having two or more rows.

5. The E-paper printing device of claim 3, wherein flat plate areas of the first printhead and the second printhead are the same.

6. The E-paper printing device of claim 3, further comprising a plurality of switch elements, each of which is connected to one of the pixel electrodes and configured for switching the one pixel electrode between modes of generating and eliminating electric field.

7. The E-paper printing device of claim 6, wherein the switch elements are Thin Film Transistors.

8. The E-paper printing device of claim 1, wherein the device further comprises a paper feeding unit for driving the feeding of the E-paper, the paper feeding unit comprises a paper feeder roller for guiding a feeding direction of the E-paper and a step motor for rotating the paper feeder roller.

9. A printing method employing a E-paper printing device, wherein, the E-paper printing device comprises a printhead for applying an electric field to the E-paper, the printhead comprises a first printhead and a second printhead disposed opposed to the first printhead, the E-paper is fed through between the first printhead and the second printhead, and portions of the first printhead and the second printhead contacting with the E-paper respectively are flat surface, a region between the opposed first and second printheads is defined as a printing region, which is divided equally along the paper feeding direction into an erasing region and a writing region, the E-paper is equally divided into N portions along the paper feeding direction, and a length of each portion of the E-paper along the paper feeding direction is equal to a length of the erasing region along the paper feeding direction, the printing method comprises the following steps:

a same-time erasing and writing step of placing a nth portion among the N portions of the E-paper in the writing region to have new graphics and texts to be written to the nth portion of the E-paper, and meanwhile, placing a (n+1)th portion of the E-paper in the erasing region to have existing graphics and text in the (n+1)th portion of the E-paper to be erased, wherein $1 \leq n \leq N-1$; a step-feeding step of feeding the E-paper a step along the paper feeding direction with a step size equal to the length of each portion of the E-paper in the paper feeding direction, such that n=n+1; and a repeating step of repeating the same-time erasing and writing step and the step-feeding step in the case of determining $n \neq N$, wherein an erasing step is performed on the first portion of the E-paper before the same-time erasing and writing step such that the first portion of the E-paper is placed in the erasing region in order to have the existing graphics and texts in the first portion of the E-paper to be erased;

wherein, in the case of determining n=N in the repeating step, placing the Nth portion of the E-paper in the writing region in order to have new graphics and texts to be written to the Nth portion of the E-paper; and wherein the E-paper printing device further comprises an adjusting unit for driving the first printhead and the second printhead to move direct toward or away from each other, such that the distance between the first printhead and the second printhead is adjustable.

10. The printing method of claim 9, wherein the first printhead and the second printhead are flat plate-like, and a distance between the first printhead and the second printhead is adjustable.

11. The printing method of claim 10, wherein the first printhead comprises a first substrate and pixel electrodes disposed on the first substrate, while the second printhead comprises a second substrate and a common electrode disposed on the second substrate, or the first printhead comprises a first substrate and pixel electrodes disposed on the first substrate, while the second printhead comprises a second substrate and a common electrode connection unit connected to a common electrode disposed on the E-paper; and the first substrate and the second substrate are disposed opposed to each other, and the pixel electrodes and the common electrode are configured for generating electric fields which are directed from the pixel electrodes to the common electrode or directed from the common electrode to the pixel electrodes.

12. The printing method of claim 11, wherein the E-paper printing device further comprises a plurality of switch elements, each of which is connected to one of the pixel electrodes and configured for switching the one pixel electrode between modes of generating and eliminating electric field.

13. A printing method employing a E-paper printing device, wherein, the E-paper printing device comprises a printhead for applying an electric field to the E-paper, the printhead comprises a first printhead and a second printhead disposed opposed to the first printhead, the E-paper is fed through between the first printhead and the second printhead, and portions of the first printhead and the second printhead contacting with the E-paper respectively are flat surface, and a region between the opposed first and second printheads is defined as a printing region, the printing method comprises the following steps:

placing the whole E-paper in the printing region;

erasing existing graphics and texts in the whole E-paper; and writing new graphics and texts into the whole E-paper.

14. The printing method of claim 13, wherein the first printhead and the second printhead are flat plate-like, and a distance between the first printhead and the second printhead is adjustable.

15. The printing method of claim 14, wherein the E-paper printing device further comprises an adjusting unit for driving the first printhead and/or the second printhead to move direct toward or away from each other, such that the distance between the first printhead and the second printhead is adjustable.

16. The printing method of claim 14, wherein the first printhead comprises a first substrate and pixel electrodes disposed on the first substrate, while the second printhead comprises a second substrate and a common electrode disposed on the second substrate, or the first printhead comprises a first substrate and pixel electrodes disposed on the first substrate, while the second printhead comprises a second substrate and a common electrode connection unit connected to a common electrode disposed on the E-paper; and the first substrate and the second substrate are disposed opposed to each other, and the pixel electrodes and the common electrode are configured for generating electric fields which are directed from the pixel electrodes to the common electrode or directed from the common electrode to the pixel electrodes.

17. The printing method of claim 16, wherein the E-paper printing device further comprises a plurality of switch elements, each of which is connected to one of the pixel electrodes and configured for switching the one pixel electrode between modes of generating and eliminating electric field.

* * * * *